US005960475A

United States Patent [19]

Fewtrell

[11] Patent Number: 5,960,475

[45] Date of Patent: Oct. 5, 1999

[54] PROTECTIVE GARMENTS

[75] Inventor: James Fewtrell, Richmond, United Kingdom

[73] Assignee: 3M Innovative Properties Company, St. Paul, Minn.

[21] Appl. No.: 09/098,101

[22] Filed: Jun. 16, 1998

[30] Foreign Application Priority Data

Jun. 20, 1997 [GB] United Kingdom ..... 9713014

[51] Int. Cl.[6] ..... A41D 13/02

[52] U.S. Cl. ..... 2/82; 2/79; 2/457; 2/901

[58] Field of Search ..... 2/456, 457, 79, 2/82, 901, DIG. 1, 69, 93, 51, 114, 81, 84

[56] References Cited

U.S. PATENT DOCUMENTS

| | | | |
|---|---|---|---|
| 4,023,223 | 5/1977 | Anderson et al. | 2/79 |
| 4,038,698 | 8/1977 | Smith . | |
| 4,190,010 | 2/1980 | Bibby | 112/419 |
| 4,272,851 | 6/1981 | Goldstein | 2/79 |
| 4,513,451 | 4/1985 | Brown | 2/69 |
| 4,593,418 | 6/1986 | Simon | 2/275 |
| 4,683,593 | 8/1987 | Langley | 2/82 |
| 4,823,404 | 4/1989 | Morell et al. . | |
| 4,860,382 | 8/1989 | Markwell | 2/79 |
| 4,932,078 | 6/1990 | Jones et al. | 2/901 |
| 5,005,216 | 4/1991 | Blackburn et al. | 2/79 |
| 5,027,438 | 7/1991 | Schwarze et al. | 2/82 |
| 5,088,115 | 2/1992 | Napolitano | 2/901 |
| 5,155,867 | 10/1992 | Norvell | 2/82 |
| 5,159,716 | 11/1992 | Takata | 2/79 |
| 5,170,506 | 12/1992 | Lewis, Jr. et al. | 2/79 |
| 5,182,812 | 2/1993 | Goldsby | 2/79 |
| 5,509,142 | 4/1996 | Connell et al. | 2/79 |
| 5,586,339 | 12/1996 | Lathan . | |
| 5,774,891 | 7/1998 | Boyer | 2/79 |

FOREIGN PATENT DOCUMENTS

| | | |
|---|---|---|
| 0 233 995B1 | 9/1987 | European Pat. Off. . |
| 0 672 357 A2 | 9/1995 | European Pat. Off. . |
| 3601245C1 | 7/1987 | Germany . |
| 2 130 137 | 5/1984 | United Kingdom . |
| 2 218 320 | 11/1989 | United Kingdom . |
| WO 84/01696 | 5/1984 | WIPO . |
| WO 91/07277 | 5/1991 | WIPO . |
| WO 91/09544 | 7/1991 | WIPO . |

*Primary Examiner*—Amy Vanatta
*Attorney, Agent, or Firm*—Cecilia A. Hill; Karl G. Hanson

[57] ABSTRACT

A protective suit 1 comprises a trouser portion 2 which is formed from a fluid-impermeable barrier material, and an upper body portion 3 of which part 8 at least is formed from a breathable barrier material. The fluid-impermeable barrier material may be a closed plastic film or a laminate thereof, and the breathable barrier material may be a microporous film or a non-woven laminate material.

12 Claims, 4 Drawing Sheets

PROTECTIVE GARMENTS

Figure 1:
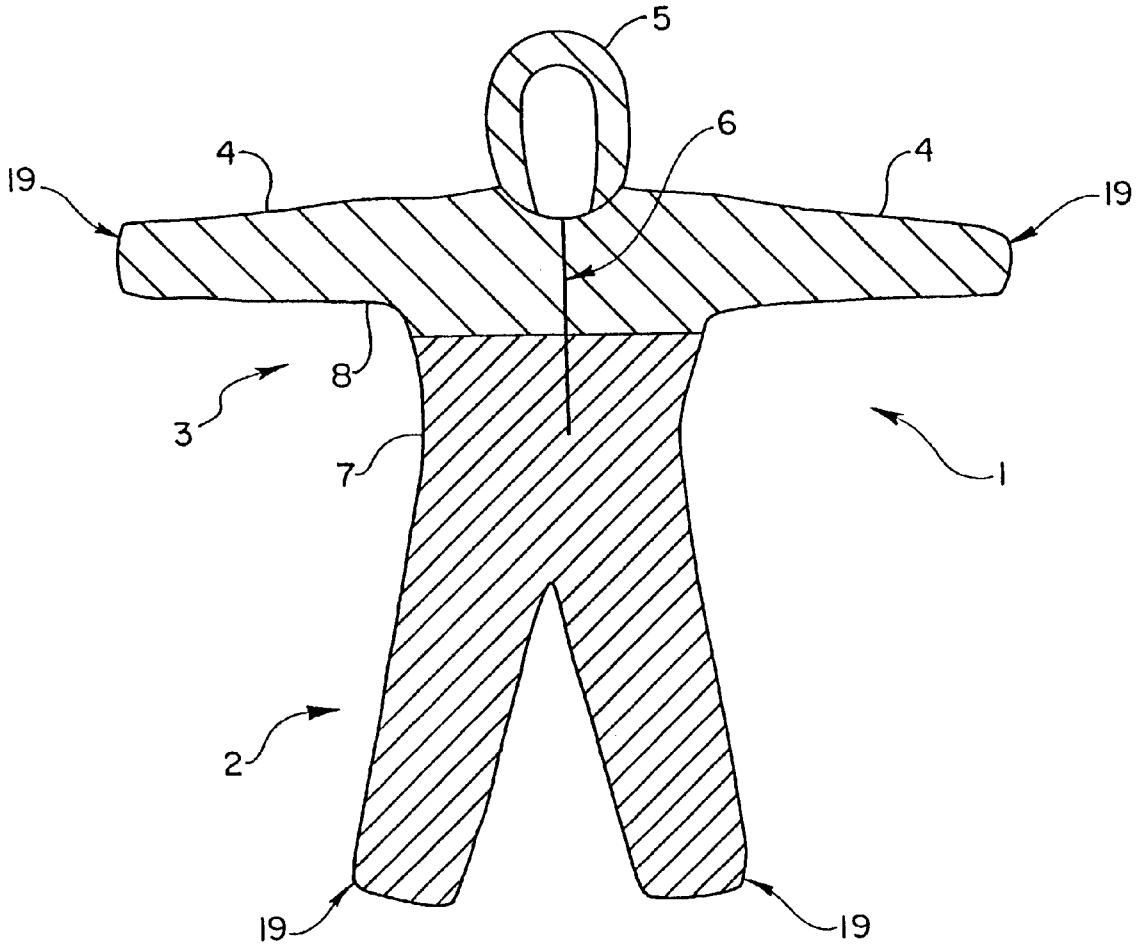

This application claims priority under 35 U.S.C. § 119 to GB 9713014.0 filed Jun. 20, 1997.

The present invention relates to protective garments and, more especially, to protective suits which comprise both a trouser portion and an upper body portion. The invention is particularly concerned with protective garments which are intended to be discarded when they become contaminated.

The use of disposable protective garments in particular working environments is well established. The garments are intended to protect the wearer from various hazards (for example fine particles, solvents and aggressive liquids) and/or to protect the workplace from contamination by the people working in it. Disposable protective garments generally have a short life time and are typically worn no more than four times, depending on the environment in which they are used, following which they are discarded. They offer the advantage of enabling the expensive laundering of contaminated garments to be eliminated, and of facilitating the careful handling of contaminated garments when that is necessary.

The cost of any disposable protective garment is important and should be kept as low as possible, consistent with the degree of protection required, to encourage the wearer not to continue using the garment after it has become contaminated. Closed plastic films are attractive materials from the point of cost and also because they are fluid impermeable and offer a high degree of protection against liquids and fine particles. Disposable protective suits made from closed plastic films, or laminates thereof, are described, for example, in U.S. Pat. Nos. 4,683,593, 4,272,851 and 4,190,010 and are also commercially available. The plastics films used in currently-available protective suits include those available, under the trade designations "Tyvek C" and "Tyvek F", from E. I. DuPont de Nemours and Co. of Wilmington Del., U.S.A.

Although suits of that type offer a high degree of protection to the wearer, they do not, allow the passage of air and water vapour from the wearer's body and, as a result, become hot and uncomfortable if worn for any length of time. The build-up of heat inside a protective suit is an important issue, not only from the point of view of comfort but also from the point of view of safety. It is generally accepted that, if the core body temperature of the wearer rises by more than about 1° C., he/she is at risk from heat stress which is dangerous and can even result in death.

The problem of regulating body temperature inside clothing is recognized in, for example, WO 91/09544. The need to provide ventilation in certain protective garments is recognized in U.S. Pat. No. 4 513 451.

A further problem associated with protective suits made from closed plastic films is that the suits have a tendency to billow as a result of internal pressure differentials generated by the wearer's movements (particularly bending and straightening at the waist and knees). That is a source of annoyance to the wearer and can also encourage leakages in the suit in regions such as the seams and seals of the garment, which are typically the areas of least resistance.

Disposable suits made from so-called "breathable" materials are known and, because they do allow the passage of air and water vapour from the wearer's body, they offer a much greater degree of comfort. Known breathable materials are generally either microporous plastic films or non-woven laminates and, although they can offer a reasonable degree of protection against fine particles, it is recognized that they can offer only reduced protection against solvents and aggressive liquids compared with closed films. Anyone who may be exposed to those hazards is, accordingly, obliged to use a suit made from closed film materials if he/she is to be adequately protected and must accept the fact, if heat stress is a problem, that the suit can only be worn for a limited period of time.

The present invention is concerned with enabling the comfort of a protective suit to be increased, thereby allowing it to be worn for a greater length of time, without jeopardizing the level of protection offered to the wearer.

The present invention provides a protective garment, part of which is formed from a fluid-impermeable barrier material and another part of which is formed from a breathable barrier material.

The present invention also provides a protective suit comprising a trouser portion and an upper body portion, part of the suit being formed from a fluidimpermeable barrier material and another part being formed from a breathable barrier material.

The present invention further provides a protective suit comprising a trouser portion and an upper body portion, part of the suit being formed from a fluidimpermeable barrier material and the remainder, or substantially the remainder, being formed from a breathable barrier material.

The term "breathable barrier material" as used herein means that the material has a water vapour transmission rate of at least 800 $g/m^2/24$ hr (in accordance with DIN 52122) and provides a barrier to at least 95% of particles greater than 3 $\mu$m. The breathable barrier material may also offer a resistance to liquid permeation. Advantageously, the breathable barrier material has an air permeability of at least 100 1 $/dm^2/min$ (in accordance with DIN 53887).

Figure 3:
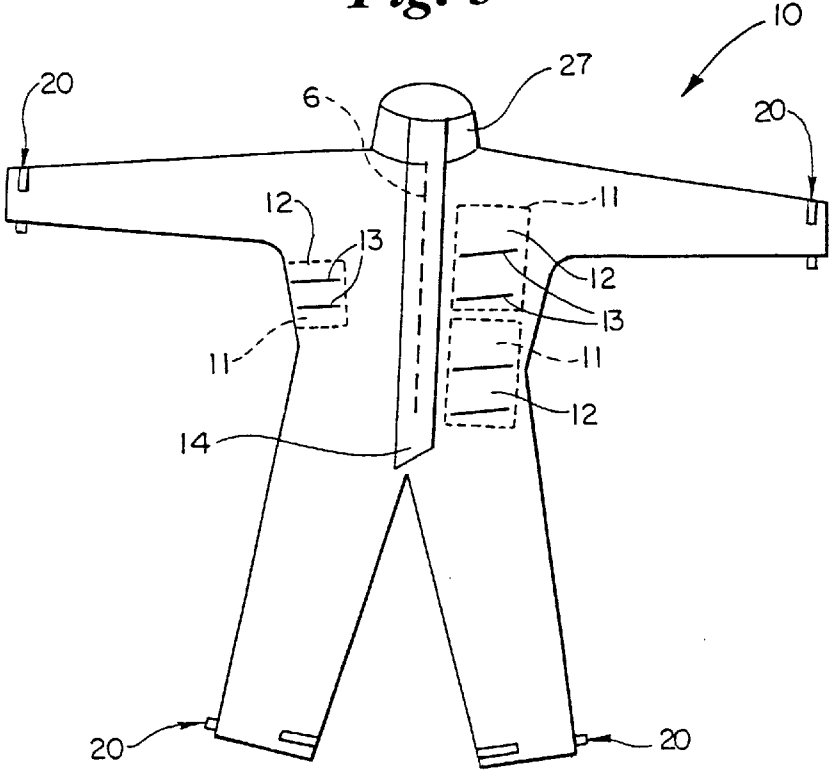
Figure 4:
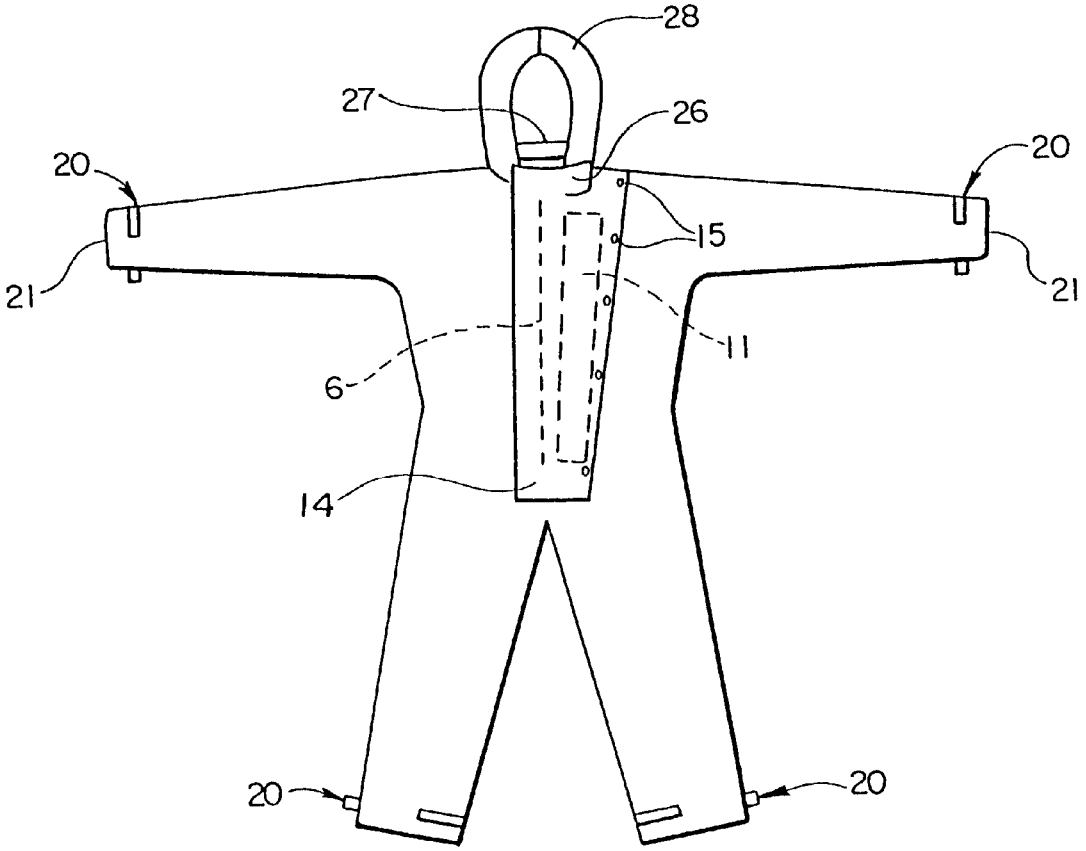
Figure 5:
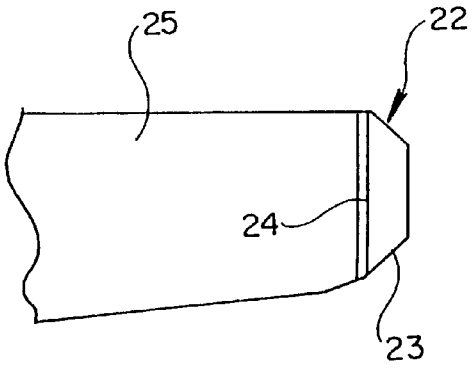
Figure 6:
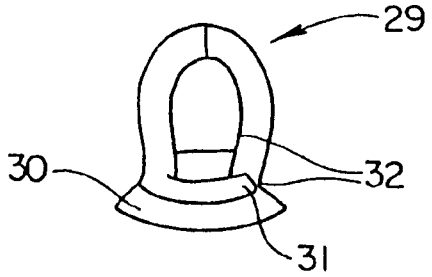
Figure 7:
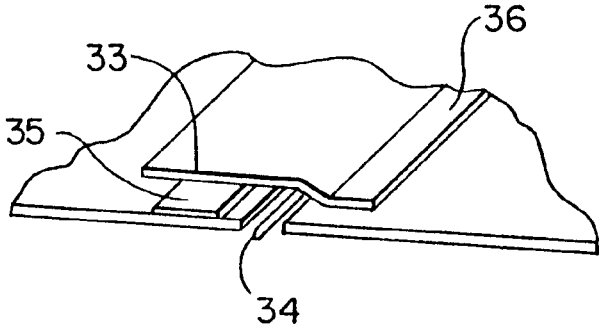

By way of example only, embodiments of the present invention will be described with reference to the accompanying drawings, in which:

FIGS. 1 to 4 are a diagrammatic front views of protective suits in accordance with the present invention; and FIGS. 5 to 7 are diagrammatic views illustrating the construction of parts of protective suits in accordance with the present invention.

FIG. 1 illustrates, diagrammatically, a one-piece protective suit 1 having a trouser portion 2 and an upper body portion 3 with sleeves 4 and a hood 5. The suit has a front access opening, indicated diagrammatically by the central line 6. Various constructional features of the suit, not shown in FIG. 1, will be described below with reference to FIGS. 5 to 7.

As indicated in FIG. 1, the trouser portion 2 of the suit 1 and a lower part 7 of the upper body portion 3 are formed from one material, and the upper part 8 of the upper body portion (excluding the hood 5) is formed from another. The material employed for the lower part 2, 7 of the suit is a fluid impervious barrier material while that employed for the upper part 8 is a breathable barrier material (as hereinbefore defined). The hood 5 may be formed from either material but, in FIG. 1, is shown as being formed from the breathable barrier material employed for the upper part 8 of the suit.

Any fluid impervious barrier material suitable for forming into garments may be used for the lower part 2, 7 of the suit 1. Particularly suitable materials are the closed plastic films (generally polyolefin films) conventionally employed for protective disposable clothing, and laminates thereof Ideally, the material is comparatively light weight and soft, with good chemical protection and strength, and, to that end, will typically have a basis weight in the range of from 35 to 70 $g/m^2$. Preferably, the material is capable of being welded to form totally sealed seams. When the material is a plastic film laminate, it is preferably used with the film on the outside of the suit 1. Examples of suitable materials are those available, under the trade designations "Tyvek C" and "Tyvek F", from E. I. DuPont de Nemours and Co.

Any breathable barrier material which is suitable for forming into garments, and which provides a barrier to the fluids likely to be encountered during use of the suit, may be used for the upper part 8 of the suit 1. Preferably, the material has a water vapour transmission rate substantially higher than 800 g/m$^2$/24 hr., most preferably about 1600 g/m$^2$/24 hr (in accordance with DIN 52122). It is also preferred that the material should provide a barrier to 100% of particles greater than 3 $\mu$m, most preferably to 99% of particles greater than 0.6 $\mu$m. Generally, the material should offer a resistance to liquid permeation giving a hydrostatic head of at least 30 mbar (in accordance with DIN 63888). Typically, such materials have a basis weight in the range of from 35 to 70 g/m$^2$. To provide increased comfort for the wearer, the material preferably also has an air permeability of at least 100 l/dm$^2$/min, most preferably about 200 l/dm$^2$/min. (in accordance with DIN 53887). The material is selected to offer good protection, having regard to the intended use of the suit, although the liquid chemical protection will inevitably be lower than that of the lower part 2, 7 of the suit. The material should also be capable of being seamed to the lower part of the suit, preferably by welding. Particularly suitable materials for the upper part of the suit are microporous plastic films and non-woven laminates conventionally employed for disposable clothing. Examples of suitable microporous plastic films are those available, under the trade designations "Tyvek Protech", from E. I. DuPont de Nemours and Co.; and, under the trade designation "Micropore" from Minnesota Mining and Manufacturing Company of St. Paul, Minn., U.S.A. Suitable non-woven laminates are typically tri-laminates comprising two outer layers of spunbond material and an inner layer of melt blown material (so-called SMS materials). Examples of suitable non-woven laminates are those available, under the trade designation "Securon", from BBA Fiberweb of Simpsonville, S.C. U.S.A.; and, under the trade designation, "MD3005", from BBA Corovin of Peine, Germany. Advantageously, the breathable material offers as low an air flow resistance as possible.

The suit 1 shown in FIG. 1 is intended for use in circumstances in which the lower part of the wearer's body requires a greater degree of protection against fluids than the upper part, in particular the arm and shoulder area. There are many circumstances in which this is the case because, generally, splashes result from liquid falling on to the ground. In those cases, the effective degree of protection offered to the wearer is reduced by a minimum, if at all, by forming the upper part 8 of the suit 1 from a breathable material. The comfort of the suit, on the other hand, is increased substantially because there is now provision for the passage of air and water vapour from the wearer's body through the upper part 8 of the suit. Provided that the breathable part of the suit constitutes a large enough part of the total surface area of the suit, it can be ensured that there is no rise in the core body temperature of the wearer, enabling the suit to be worn indefinitely without risk. Preferably, the breathable part of the suit constitutes at least 33% of the total surface area of the suit and, most preferably, about 66%. Heat loss through the upper portion of the body is generally more effective in preventing a rise in core body temperature than heat loss through other parts of the body such as the legs.

The use of a breathable material for the upper part of the suit, because it permits venting, is also of assistance in reducing the discomfort to the wearer caused by billowing of the suit.

With regard to the cost of the suit 1 shown in FIG. 1, it should be noted that the material used for the greater of the suit, namely the fluid impermeable part, is generally the least expensive. The suit 1 thus provides good protection to the wearer, and the greatest comfort, for the least cost. Typically, in a suit of the general type shown in FIG. 1, the cut of the upper part 8 of the suit is such that it can be formed from a single piece of material. That approach can, if required, be maintained even when, as in FIG. 1, the upper part 8 of the suit is formed from a different material from the lower part 2, 7.

The hood 5 of the suit 1 is ideally formed from the breathable material used for the upper part 8 of the suit since that will facilitate cooling and be softer against the wearer's head and face. The hood could, however, be formed from the fluid impermeable material used for the lower part 2, 7 of the suit.

Figure 2:
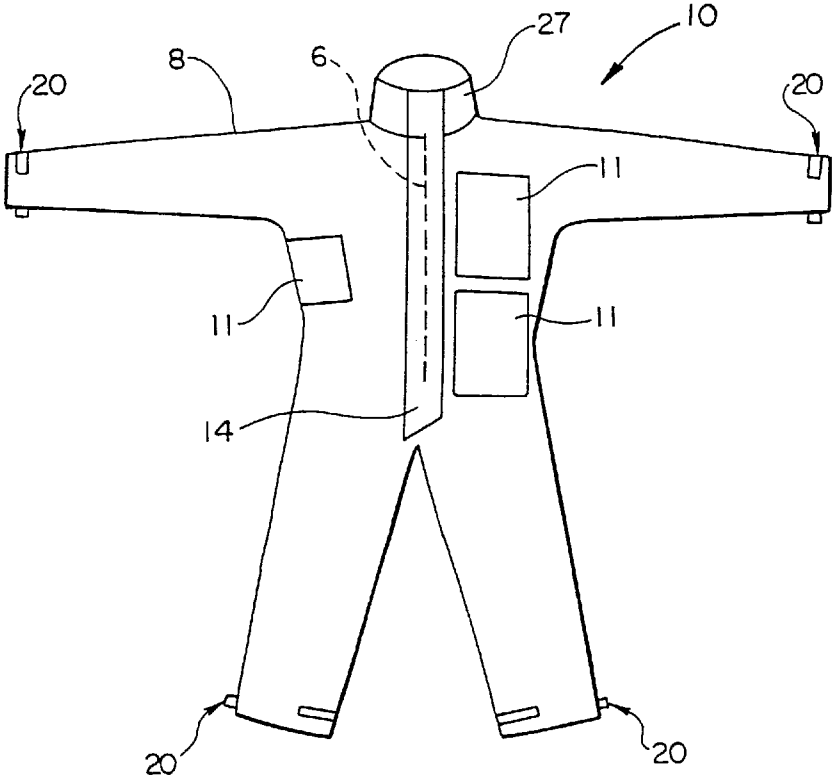

It will be appreciated that, although there are certain advantages in forming the whole of the upper part 8 of the suit 1 (excluding, possibly, the hood 5) from a breathable barrier material, it is possible to employ a breathable barrier material in other parts of the suit. For example, in some circumstances it may be preferable to form the whole of the front of the suit from a fluid impervious barrier material and to employ a breathable barrier material in the back of the suit. In other cases, the breathable barrier material may be employed less extensively than as shown in FIG. 1. FIG. 2, for example, shows a suit 10 which has only patches 11 of breathable barrier material in the upper part, specifically under the arm and on one side of the front opening 6. In this case, the surface area of breathable fabric in the suit is less than in FIG. 1 but still permits the passage of air and water vapour from the wearer's body to the exterior of the suit and provides a higher degree of comfort for the wearer than a suit which is made completely from a fluid impermeable material. This degree of comfort may, in certain circumstances, be adequate depending on the length of time for which the suit 8 is intended to be worn. If the suit 8 is to be used in an environment in which the patches might be exposed to fluids to which they do not present a barrier, it is possible to provide them with protective, vented, covers to impede the entry of fluids without unduly restricting the flow of air through the patches. FIG. 3 shows the same suit as FIG. 2 but with the patches 11 provided with protective covers 12 in which are formed slits 13. The slits 13 are similar in design to the gills of a fish and permit the flow of air through the patches 11 but impede the penetration of liquids. It will be appreciated that the covers 12 need not be separate items but can be an integral part of the fluid impermeable part of the suit 8. In a suit of the type shown in FIG. 3, the patches 11 could, in certain circumstances, be formed from a breathable barrier material which, although it presents a barrier to particles, does not present a barrier to fluids. In that case, protection against fluids will be provided only by the covers 12.

FIGS. 2 and 3 show suits which do not have hoods. Both suits could, if desired, be provided with integral hoods of the type shown at 5 in FIG. 1 or with separate hoods as described below with reference to FIG. 6.

FIG. 4 shows an alternative to the suit shown in FIG. 3. In this case, there is an elongated patch 11 of breathable barrier material adjacent the front access opening 6 of the suit, covered by a flap 14 which also extends over and protects the front opening 6. The free edge of the flap is secured down on the front of the suit by snap or hook-and-loop fasteners 15.

It will be appreciated that the patch locations illustrated in FIGS. 2 to 4 are examples only and that many other locations, or combinations of locations, are possible. The patches are, however, preferably not positioned at the back of the suit where air flow through a patch could be impeded by breathing apparatus.

The protection offered by a suit as shown in any one of FIGS. 1 to 4 (and, indeed, any other form of protective suit) can be further enhanced by reducing the number of potential leakage points in the suit and by reducing to a minimum any leakage that does occur. The potential leakage points in a protective suit are at the seams generally; at the wrists and ankles; around the neck and face; and at the access opening (e.g. the front opening 6 in FIG. 1). Methods of reducing leakage at those points are described below.

Various ways have been proposed for reducing leakage at the seams of protective garments. For example, U.S. Pat. No. 4,683,593 describes the use of ultrasonic welding to form the seams in a suit which is made of a plastic film laminate while U.S. Pat. No. 4,593,418 describes the inclusion, in a stitched seam, of an elastomeric tape. It is also known to cover stitched seams with tape, to reduce leakage. Welding (in particular, ultrasonic welding) is preferred, however, as being the simplest way of achieving seams which have a high integrity. Consequently, the materials used for a garment should be capable of being welded (including to each other in the case of the suits 1, 8 shown in FIGS. 1 to 4). Polypropylene is particularly suitable for ultrasonic welding and is, accordingly, a preferred material. In the case of the suits 1, 8 shown in FIGS. 1 to 4, the fluid impermeable material is preferably a polypropylene or polyethylene film and the breathable barrier material is preferably a polypropylene SMS material, enabling all of the seams in and between those materials to be ultrasonically welded.

As a further aid to reducing leakage at the seams in a protective garment, elastic inserts can be provided in those parts of the garment that are subject to a higher degree of stress when the garment is being worn, thereby reducing the stress on the seams in those areas. In the case of a protective suits of the type shown in FIGS. 1 to 4, for example, a rectangular insert of elastic material (typically about 10 cm×10 cm) can be welded into the suit under the arms and/or at the back of the neck in the hood. The elastic material, in addition to being weldable to the suit material, should have a high elasticity and chemical resistance. A suitable elastic material is described in WO 91/07277.

Protective garments are conventionally elasticated at the wrists/ankles as indicated at 19 in FIG. 1, and the wearer usually tapes the elasticated openings to gloves/boots to cut down leakage at those points. Conventional elasticated openings are, however, often left quite wide to ensure that the user does not have too much difficulty getting into and out of the garment, and that can make it difficult for the wearer to close off the openings by taping them down to gloves or boots. An improvement can be achieved by providing a hook-and-loop adjustment system at each opening, either as an addition or as an alternative to the conventional sewn-in elastic. FIGS. 2 to 4 show hook-and-loop adjustments 20 (comprising a tab and an attachment strip) at the wrist and ankle openings of the suits, allowing these openings to be gathered up by the user (after the suit has been put on) to fit his/her wrists and ankles as closely as possible. FIG. 4 shows the conventional sewn-in elastic 21 retained at the wrist openings, where it may assist the wearer in securing the hook-and-loop adjustments 20, but omitted at the ankle openings so that the latter are as wide as possible to assist the user in donning the suit particularly when wearing boots.

Similar hook-and-loop adjustments could, if desired, be provided on the back of a one-piece suit, at the waist, to enable the fit of the garment in this area to be adjusted to suit the wearer. Likewise, when a protective garment has an integral hood, hook-and-loop adjustments can also be provided at the nape of the neck.

As an alternative, the sewn-in elastic conventionally used at wrist openings can be replaced by a welded/glued cuff which offers the further advantage of eliminating stitch holes through which leakage can occur. The construction of such a cuff 22 is illustrated in FIG. 5. The cuff 22 comprises a comparatively wide band 23 of elastic and is tapered so that it defines an opening, at the end of the sleeve 25, which decreases in size in the direction away from the sleeve. The band 23 is secured at 24 to the end of the sleeve 25, either by a suitable adhesive or by ultrasonic welding, and the taper on the cuff is selected to ensure that the narrow end is a close fit around the wrist. The elastic material from which the cuff is formed should be able to ensure this close fit without undue pressure on the wrist, while accommodating a wide range of hand and wrist sizes, and one suitable type of material for this purpose is that described in the above-mentioned WO 91/07277. The cuff 22 can be formed by first forming a cone of the elastic material and then removing the pointed end of the cone to leave the desired tapered ring. Any seams required in the elastic material can be formed by ultrasonic welding. The cuff 22 offers the advantage of increased comfort because it contacts the wearer's wrist over a much larger area than a narrow strip of elastic.

To reduce leakage at the neck area of a one-piece protective suit, it is conventional to provide a flap such as that shown at 26 in FIG. 4 to cover the top of the access opening 6 which is typically closed by a zip. In addition, an elasticated collar 27 is preferably also provided around the neck of the suit, as shown in FIGS. 2 and 3, to assist further in reducing leakage at the neck area. The elasticated collar 27 is preferably retained even when the suit is provided with an integral hood 28 as shown in FIG. 4. In the case of a suit which does not have an integral hood, such as those shown in FIGS. 2 and 3, a separate hood 29 may be provided as shown in FIG. 6. The hood 29 is intended to fit over the elasticated collar 27 and is provided with an extended shroud 30 to protect against splashes. The hood 29 also has a closure flap 31 and is elasticated around the neck and around the face opening, as indicated at 32.

Leakage at a zip closure in a protective garment, for example a zip closure in the front access opening 6 of the suits shown in FIGS. 1 to 4, can be reduced by providing the zip cover flap 14 with some form of seal, for example, a peel-off adhesive strip which locates over the zip. Alternatively, or in addition, the conventional cloth-backed zip fastener which is stitched into the garment can be replaced by an extruded plastic zip which is welded or glued in place. As a further alternative, illustrated in FIG. 7, the zip cover flap 14 is formed from a polyvinylchloride (PVC) foam material which is welded, at 36, to the outside of the garment adjacent the zip 34 and a strip of PVC foam material 35 is located on the other side of the zip. The PVC material selected is one that has a degree of tack so that the flap 14 will seal against strip 35 when the two are touched together and cover over the zip 34. The entire width of the strip 35 is preferably contacted by the flap 14 and is preferably no less than 15 mm.

What is claimed is:

1. A protective garment that comprises:

a first part that is formed from a fluid-impermeable barrier material; and a second part that is formed from a breathable barrier material that permits passage of air between the interior and exterior of the garment, the second part forming substantially the remainder of the protective garment and offering a resistance to liquid permeation by giving a hydrostatic head of at least 30 mbar.

2. The protective garment of claim 1 which comprises a trouser portion and an upper body portion.

3. The protective garment of claim 2, wherein the trouser portion is formed from a fluid-impermeable barrier material.

4. The protective garment of claim 2, wherein a part of the upper body portion is formed from a breathable barrier material.

5. The protective garment of claim 4, wherein the whole of an upper part of the garment is formed from a breathable barrier material.

6. The protective garment of claim 1, wherein the breathable barrier material comprises at least 33% of the surface area of the garment.

7. The protective garment of claim 2, wherein the trouser portion and the upper body portion form a one-piece garment.

8. The protective garment of claim 1, wherein the breathable barrier material has an air permeability of at least 100 liter/$dm^2$/min.

9. The protective garment of claim 1, wherein the fluid-impermeable barrier material is a closed plastic film or a laminate thereof.

10. The protective garment of claim 1, wherein the breathable barrier material is a microporous plastic film or a non-woven laminate material.

11. The protective garment of claim 2, wherein the upper body portion has sleeves with cuffs, each cuff comprising a band of elastic material secured to the end of the sleeve and tapered to define an opening which decreases in size in the direction away from the sleeve.

12. The protective garment of claim 11, wherein the cuff is welded/bonded by an adhesive to the end of the sleeve.

* * * * *